US011248325B2

(12) United States Patent
Murphy

(10) Patent No.: US 11,248,325 B2
(45) Date of Patent: Feb. 15, 2022

(54) LAUNDRY APPLIANCE HAVING A PROCESSING BELT

(71) Applicant: WHIRLPOOL CORPORATION, Benton Harbor, MI (US)

(72) Inventor: Sayer J. Murphy, St. Joseph, MI (US)

(73) Assignee: Whirlpool Corporation, Benton Harbor, MI (US)

( * ) Notice: Subject to any disclaimer, the term of this patent is extended or adjusted under 35 U.S.C. 154(b) by 0 days.

(21) Appl. No.: 17/030,494

(22) Filed: Sep. 24, 2020

(65) Prior Publication Data

US 2021/0148028 A1 May 20, 2021

Related U.S. Application Data

(60) Provisional application No. 62/937,294, filed on Nov. 19, 2019.

(51) Int. Cl.
*D06F 13/04* (2006.01)
*D06F 58/12* (2006.01)

(52) U.S. Cl.
CPC ..... *D06F 13/04* (2013.01); *D06F 58/12* (2013.01)

(58) Field of Classification Search
CPC ..... D06F 13/04; D06F 58/12
See application file for complete search history.

(56) References Cited

U.S. PATENT DOCUMENTS

| | | | | |
|---|---|---|---|---|
| 3,009,343 | A | 11/1961 | Bochan | |
| 3,321,843 | A * | 5/1967 | Taran | D06F 37/30 34/596 |
| 3,932,947 | A | 1/1976 | Smoot | |
| 2011/0072679 | A1 | 3/2011 | Kim et al. | |

FOREIGN PATENT DOCUMENTS

| | | |
|---|---|---|
| CN | 108642790 | 10/2018 |
| JP | S4914660 | 2/1974 |

* cited by examiner

*Primary Examiner* — Joseph L. Perrin
*Assistant Examiner* — Irina Graf
(74) *Attorney, Agent, or Firm* — Price Heneveld LLP

(57) ABSTRACT

A laundry appliance includes a cabinet defining a processing chamber within an interior. A processing belt is positioned between opposing sidewalls of the cabinet and partially defines the processing chamber. The processing belt translates vertically within the interior to define a rear portion of the processing chamber.

20 Claims, 18 Drawing Sheets

LAUNDRY APPLIANCE HAVING A PROCESSING BELT

CROSS-REFERENCE TO RELATED APPLICATION

This application claims priority to and the benefit under 35 U.S.C. § 119(e) of U.S. Provisional Patent Application No. 62/937,294 filed on Nov. 19, 2019, entitled LAUNDRY APPLIANCE HAVING A PROCESSING BELT, the entire disclosure of which is hereby incorporated herein by reference.

BACKGROUND OF THE DISCLOSURE

The present disclosure generally relates to laundry appliances, and more specifically, a laundry appliance that incorporates a processing belt that defines the processing chamber for treating articles of laundry.

SUMMARY OF THE DISCLOSURE

According to one aspect of the present disclosure, a laundry appliance includes a cabinet defining an interior. A processing chamber is defined within the interior. A processing belt partially defines the processing chamber and translates vertically within the interior.

According to another aspect of the present disclosure, a laundry appliance includes a cabinet defining a processing chamber within an interior. A processing belt is positioned between opposing sidewalls of the cabinet and partially defines the processing chamber. The processing belt translates vertically within the interior to define a rear portion of the processing chamber.

According to yet another aspect of the present disclosure, a laundry appliance includes a cabinet defining an interior. A processing chamber is defined within the interior. A processing belt partially defines the processing chamber and translates vertically within the interior. A machine compartment is positioned within the interior. The processing belt partially separates the machine compartment from the processing chamber. A drive train defines an operational path of the processing belt. A tumbling portion of the operational path defines a portion of the processing chamber and a return portion of the operational path is positioned distal from the processing chamber.

These and other features, advantages, and objects of the present disclosure will be further understood and appreciated by those skilled in the art by reference to the following specification, claims, and appended drawings.

Figure 1:
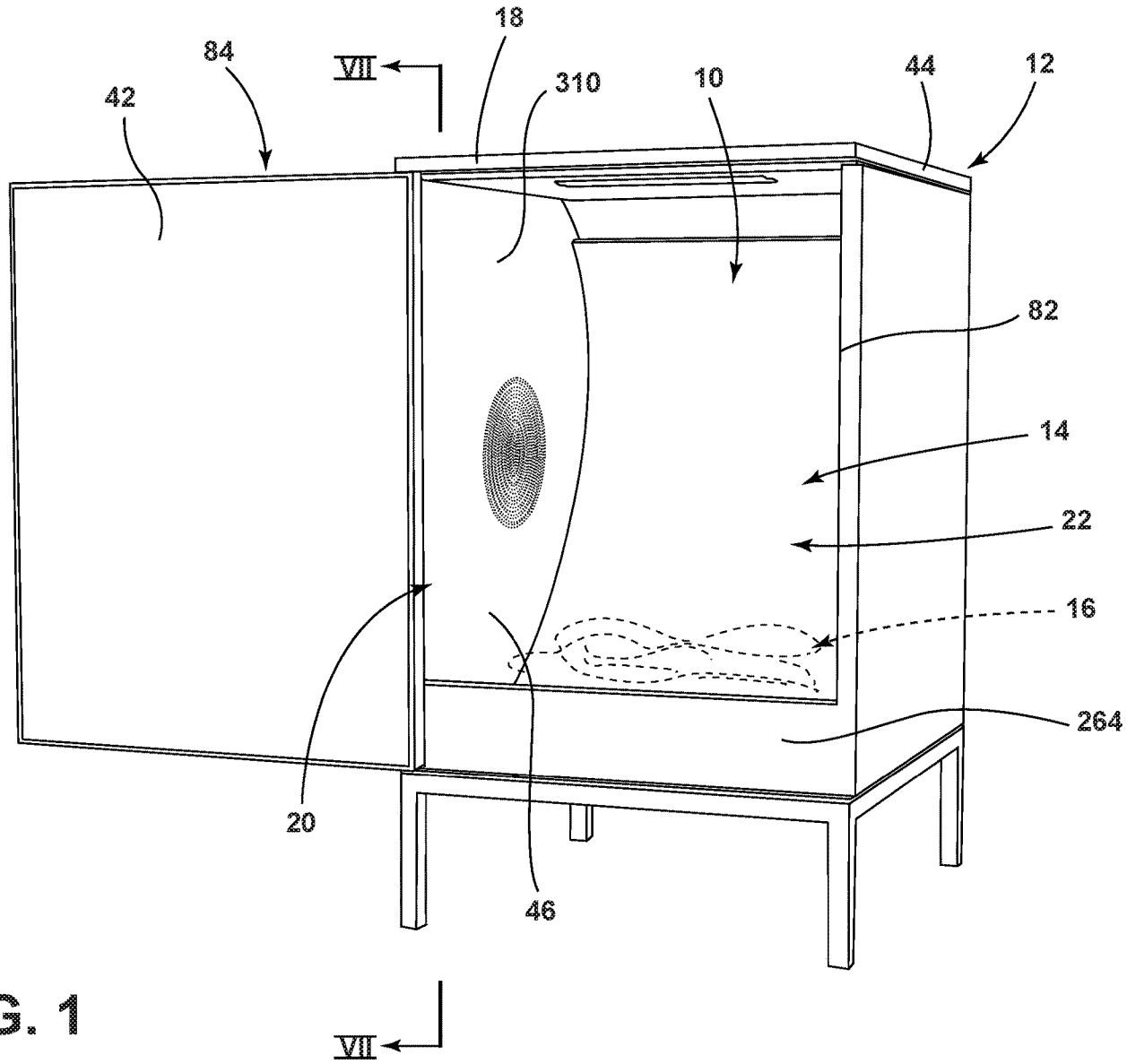
FIG. 1 is a front perspective view of an aspect of the laundry appliance incorporating a processing belt, with the door for the appliance in an open position.
Figure 2:
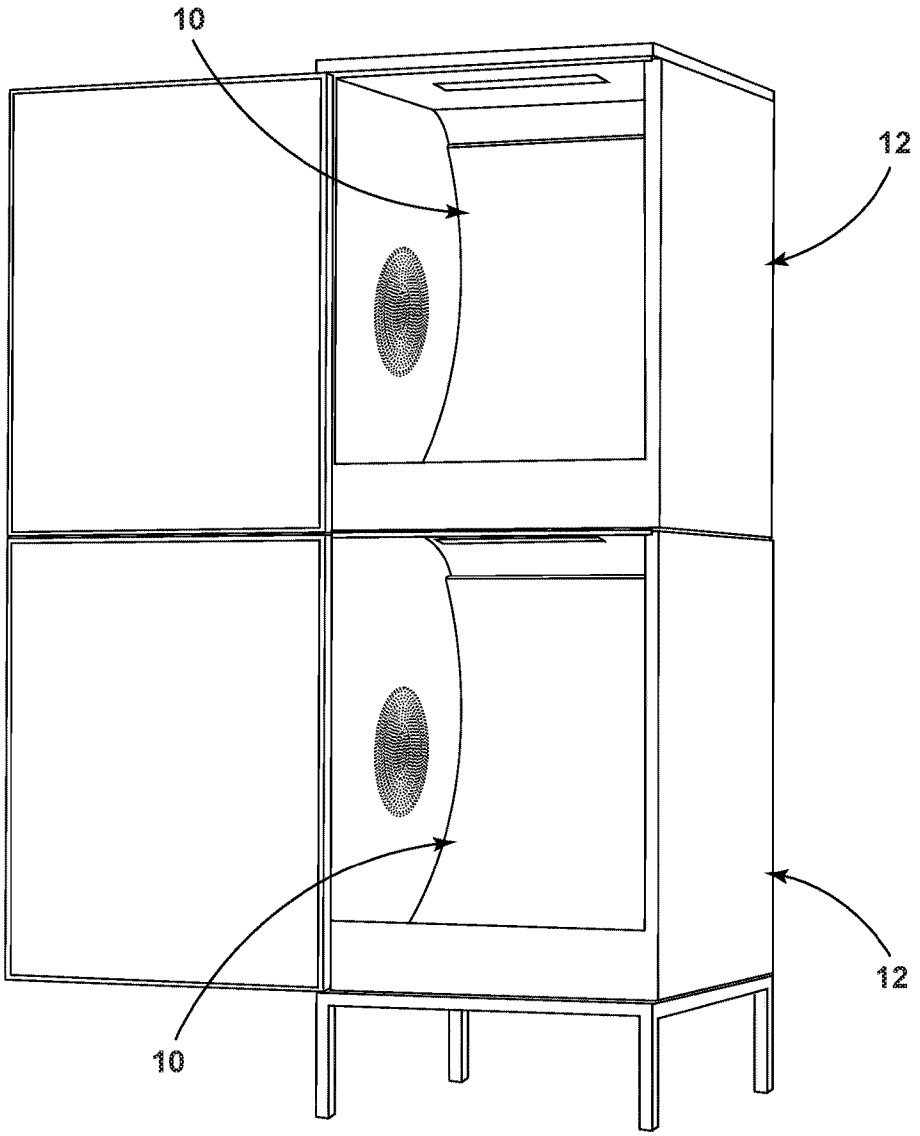
FIG. 2 is a front perspective view of a stacked configuration of an aspect of the laundry appliance.
Figure 3:
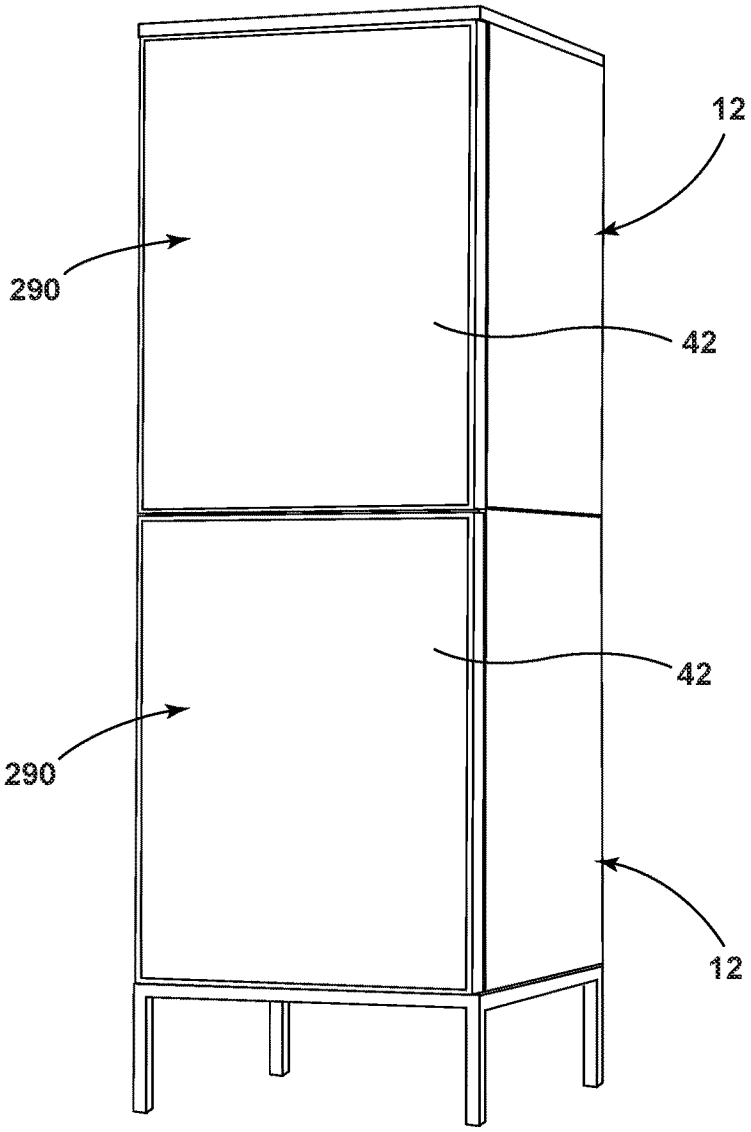
FIG. 3 is a front perspective view of the stacked laundry appliance of FIG. 2 with the doors shown in a closed position.
Figure 4:
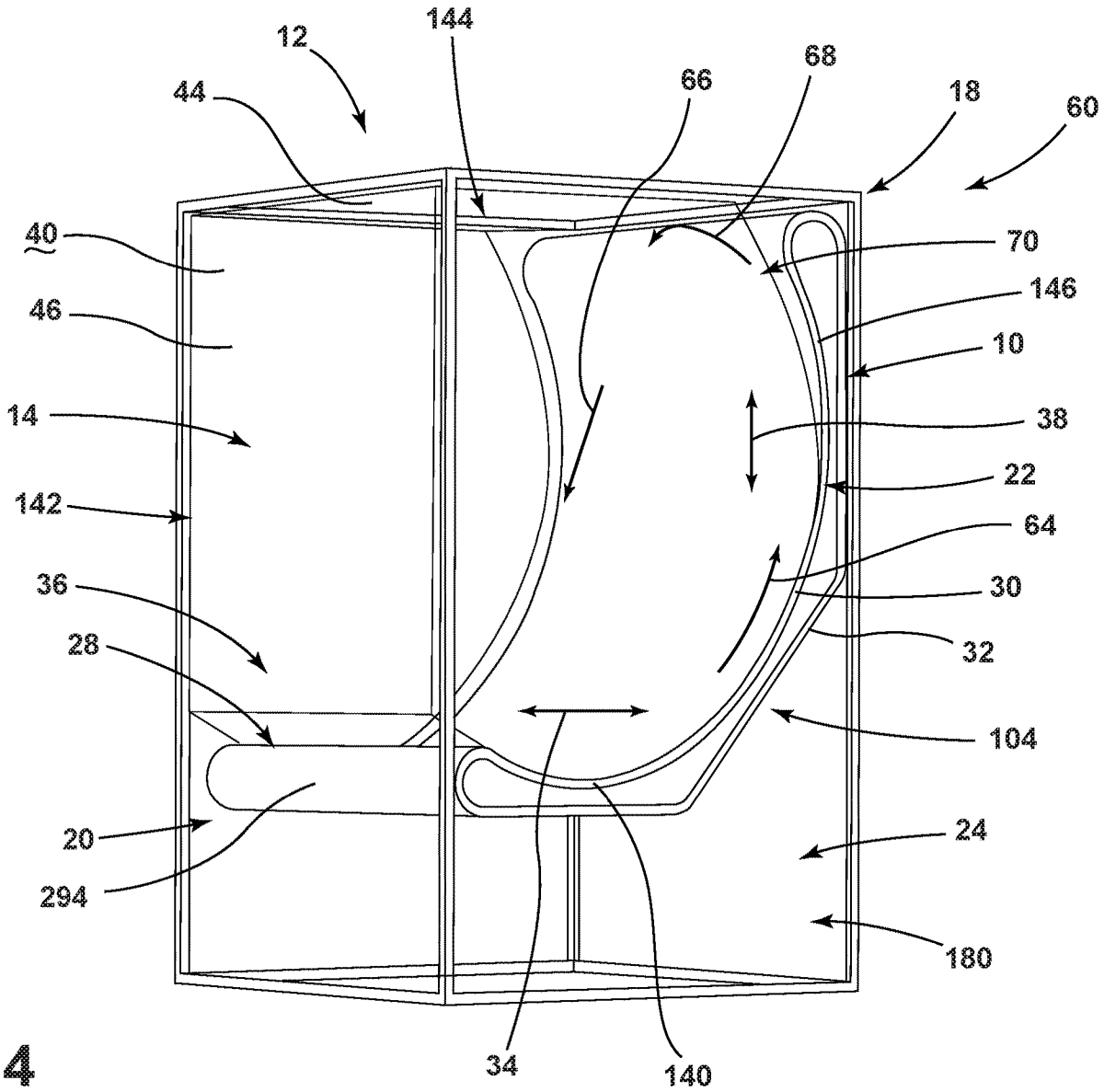
FIG. 4 is a schematic perspective view of an aspect of the processing belt for the laundry appliance, and showing an exemplary operating path for the processing belt in a tumbling condition.

The components in the figures are not necessarily to scale, emphasis instead being placed upon illustrating the principles described herein.

DETAILED DESCRIPTION

The present illustrated embodiments reside primarily in combinations of method steps and apparatus components related to a laundry appliance that incorporates a processing belt that defines a processing chamber within a cabinet for the laundry appliance. Accordingly, the apparatus components and method steps have been represented, where appropriate, by conventional symbols in the drawings, showing only those specific details that are pertinent to understanding the embodiments of the present disclosure so as not to obscure the disclosure with details that will be readily apparent to those of ordinary skill in the art having the benefit of the description herein. Further, like numerals in the description and drawings represent like elements.

For purposes of description herein, the terms "upper," "lower," "right," "left," "rear," "front," "vertical," "horizontal," and derivatives thereof shall relate to the disclosure as oriented in FIG. 1. Unless stated otherwise, the term "front" shall refer to the surface of the element closer to an intended viewer, and the term "rear" shall refer to the surface of the element further from the intended viewer. However, it is to be understood that the disclosure may assume various alternative orientations, except where expressly specified to the contrary. It is also to be understood that the specific devices and processes illustrated in the attached drawings, and described in the following specification are simply exemplary embodiments of the inventive concepts defined in the appended claims. Hence, specific dimensions and other physical characteristics relating to the embodiments disclosed herein are not to be considered as limiting, unless the claims expressly state otherwise.

The terms "including," "comprises," "comprising," or any other variation thereof, are intended to cover a non-exclusive inclusion, such that a process, method, article, or apparatus that comprises a list of elements does not include only those elements but may include other elements not expressly listed or inherent to such process, method, article, or apparatus. An element proceeded by "comprises a . . . " does not, without more constraints, preclude the existence of additional identical elements in the process, method, article, or apparatus that comprises the element.

Referring to FIGS. 1-16, reference numeral 10 generally designates a processing belt that is incorporated within a laundry appliance 12, where the processing belt 10 defines a portion of a processing chamber 14 for treating articles of laundry 16 within the laundry appliance 12. According to various aspects of the device, the laundry appliance 12 can include the cabinet 18 that defines an interior 20. The processing chamber 14 is defined within the interior 20. The processing belt 10 partially defines the processing chamber 14 and translates within a rear portion 22 of the interior 20. A machine compartment 24 is positioned within the interior 20. The processing belt 10 defines a rearward boundary of the processing chamber 14 and also partially separates the machine compartment 24 from the processing chamber 14. A drive train 26 defines an operational path 28 of the processing belt 10. A tumbling portion 30 of the operational path 28 defines a portion of the processing chamber 14 and a return portion 32 of the operational path 28 is positioned distal from the processing chamber 14. The processing belt 10 and the drive train 26 are configured such that lateral translation 34 of the processing belt 10 occurs within a lower portion 36 and vertical translation 38 of the processing belt 10 occurs within the rear portion 22 of the interior 20 for the cabinet 18 of the laundry appliance 12. Accordingly, an inside surface 40 of a door 42 of the top wall 44 and opposing sidewalls 46 of the cabinet 18 are generally not concealed by the processing belt 10 and further define the processing chamber 14.

Referring again to FIGS. 1-16, the processing belt 10 operates via the drive train 26 in a number of operating conditions. One such condition is a tumbling condition 60 that directs the tumbling portion 30 of the processing belt 10 away from the door 42. In this manner, during operation of the drive train 26, and a drive wheel 62 of the drive train 26, the processing belt 10 operates from an area near the door 42, through a lateral translation 34 within the lower portion 36 of the interior 20 and then through a vertical translation 38 within the rear portion 22 of the interior 20. Using the tumbling condition 60, the processing belt 10 operates to manipulate articles of laundry 16 vertically and generally upward 64 within the processing chamber 14. As the articles of laundry 16 are moved along the tumbling portion 30 of the processing belt 10, the processing belt 10 moves these articles of laundry 16 in an upward motion. As the articles of laundry 16 reach, and potentially pass, an angle of repose for the articles of laundry 16, the laundry 16 falls in a downward 66 and generally forward 68 direction within the processing chamber 14. This downward 66 and forward 68 motion of the articles of laundry 16, in combination with the upward vertical translation 38 of the processing belt 10, generates the tumbling motion 70 of the articles of laundry 16 within the processing chamber 14.

Referring again to FIGS. 1-16, the processing belt 10 is also operational in an unload condition 80 that directs the tumbling portion 30 of the processing belt 10 toward an aperture 82 for the door 42. In the unload condition 80, the door 42 is typically in an open position 84 such that articles of laundry 16 can be moved along a lateral translation 34 through the aperture 82 via operation of the processing belt 10 in the unload condition 80. Using the unload condition 80, the processing belt 10 can be operated in a fashion similar to a conveyor belt for manipulating the articles of laundry 16 from the processing chamber 14, through the aperture 82 and into a laundry basket 86 or other laundry container. The unload condition 80 is generally and schematically exemplified in FIG. 11.

Figure 5:
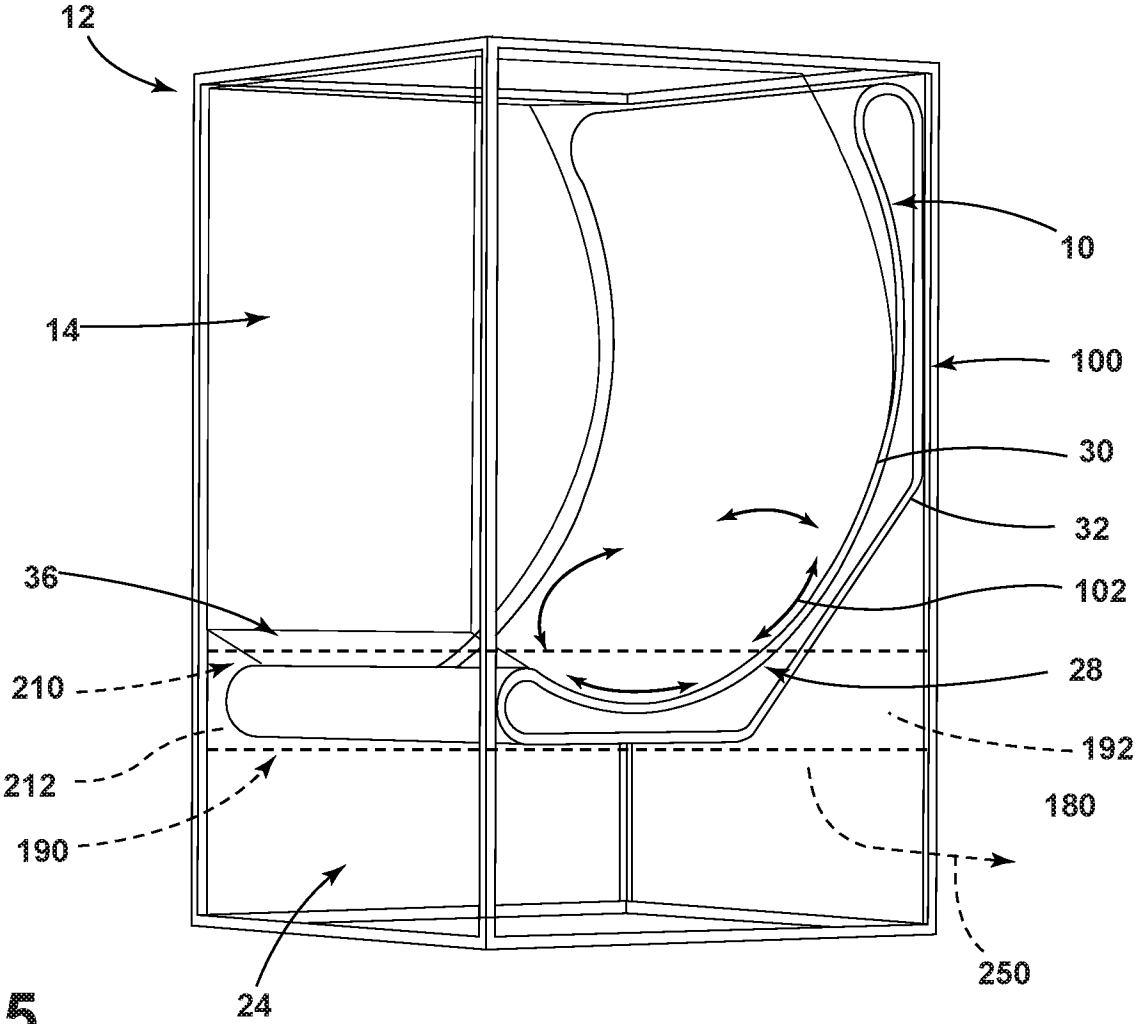
FIG. 5 is a schematic perspective view of an aspect of the processing belt for the laundry appliance and illustrating an agitating condition.

The processing belt 10, in combination with the drive train 26, can also define various agitating conditions 100, as exemplified in FIG. 5. These agitating conditions 100 can be defined by various reciprocal motions 102 of the processing belt 10 within the interior 20. The agitating conditions 100 can also be defined by generally continuous translational movement 104 of the processing belt 10 in opposing directions. These various movements of the processing belt 10 in the agitating condition 100 can be defined by various combinations of reciprocations, reversals, and other similar translational movements 104 of the processing belt 10 within the interior 20 of the laundry appliance 12. These combinations of movements that define the various agitating conditions 100 of the processing belt 10 can be utilized within specific portions of a particular laundry cycle, within different selected laundry cycles, and other similar conditions as the laundry appliance 12 is utilized.

Referring now to FIGS. 4-11, the drive system for the processing belt 10 includes the drive train 26. The processing belt 10 extends around various guide rollers 160 of the drive train 26 to be translated through the operational path 28. As discussed above, this translational movement 104 defines the various operating conditions of the processing chamber 14 for the laundry appliance 12. The drive train 26 can include a drive wheel 62 that is typically coupled to a motor 126, and an idler wheel 120 that can be positioned at an opposing end of the drive train 26 with respect to the drive wheel 62. The drive train 26 can also include one or more guide members 122 and at least one belt tensioner 124.

Typically, the drive wheel 62 will include a low speed motor 126 for rotating the drive wheel 62 and translating the processing belt 10 through the operational path 28. This motor 126 for the drive train 26 can include any one of various motors 126 that can include, but are not limited to, stepper motors, direct drive motors, belt-drive motors, servo motors, and other similar drive mechanisms. The motor 126 for the drive train 26 can also include a variable speed motor. The drive motor 126 can include a reversible motor that can account for the various operational conditions of the processing belt 10.

In certain aspects of the device, specific operating conditions for the processing belt 10 can be operated by different drive members or separate motors 126. By way of example, and not limitation, a continuous translational movement 104 of the processing belt 10 may be provided by a single directional or bi-directional motor 126 that can translate the processing belt 10 continuously in one direction. Such an operating condition would be indicative of the tumbling condition 60 and/or the unload condition 80. The processing belt 10 can also include a separate motor 126 for operating the various agitating conditions 100 of the processing belt 10, where greater torque and reversibility of the processing belt 10 can be required for accomplishing the various reciprocating agitating conditions 100 for the processing belt 10.

Referring again to FIGS. 4-11, the drive train 26 can dictate the shape of the processing belt 10 as it moves through the interior 20 of the cabinet 18 for defining the processing chamber 14. As exemplified in FIGS. 4-7, the general shape of the tumbling portion 30 of the processing belt 10, which defines the processing chamber 14, can have a general elliptical configuration. In this elliptical configuration, a lateral portion 140 of the processing belt 10 can be higher towards the front portion 142 and the rear portion 22 of the processing chamber 14, and lower therebetween. Additionally, the elliptical configuration of the processing belt 10 can include a vertical portion 146 of the processing belt 10 that can extend upward 64 to a top portion 144 of the interior 20 for the laundry appliance 12.

In various aspects of the device, the shape of the tumbling portion 30 of the processing belt 10 can include an elliptical configuration, a sloped configuration, a circular configuration, combinations thereof, and other similar shapes that extend through a lower portion 36 of the interior 20 and a rear portion 22 of the interior 20. In each of these configurations, the processing belt 10 is positioned to provide a clear opening space at the aperture 82 for the door 42 of the cabinet 18. In this manner, the processing belt 10 does not interfere with the loading or unloading of articles of laundry 16 within the processing chamber 14. Additionally, this configuration of the processing belt 10 allows for the unload condition 80, where the translational movement 104 of the processing belt 10 can provide for lateral translation 34 of articles of laundry 16 through the aperture 82 and to a basket 86.

In various aspects of the device, the various guide members 122 and belt tensioners 124 can be operable such that the shape of the tumbling portion 30 of the processing belt 10 and the shape of the processing chamber 14 can be modifiable and adjustable between laundry cycles and within laundry cycles, depending upon the desired needs of a particular operation being performed within the laundry appliance 12. By way of example, and not limitation, an agitating condition 100 of the laundry appliance 12 may require a processing chamber 14 and tumbling portion 30 of the processing belt 10 to have a different shape than that of an unload condition 80 or a tumbling condition 60 of the processing belt 10 and the processing chamber 14.

Typically, the drive train 26 will provide a consistent shape for the processing belt 10 and the processing chamber 14. In such a condition, the drive train 26 can include guide members 122 that maintain the shape and configuration of the processing belt 10 as it moves through the interior 20 to define the processing chamber 14. The guide members 122 can include one or more guide rollers 160 and one or more guide rails 162 that are positioned between the tumbling portion 30 and the return portion 32 of the processing belt 10. The guide members 122 can also include opposing guide rails 162 or tread rails that are positioned proximate the opposing sidewalls 46 of the cabinet 18. These guide rails 162 can be located on opposing surfaces of the tumbling portion 30 of the processing belt 10 to maintain the position of the processing belt 10 as it translates through the interior 20. Additionally, these guide rails 162 also serve to maintain a generally consistent shape of the processing chamber 14 during operation of the processing belt 10. The guide rollers 160 help with the lateral and vertical translation 34, 38 of the processing belt 10 and also maintains the tumbling portion 30 of the processing belt 10 separated from the return portion 32. This separation minimizes friction between these portions of the processing belt 10. In addition, the space between the tumbling and return portions 30, 32 of the processing belt 10 that is maintained by the guide rollers 160 can be utilized as part of an interstitial area 180 for running various services and conduits, such as the airflow path 186 and the fluid system 190, through the cabinet 18 of the appliance 12 and between the machine compartment 24 and the processing chamber 14.

Referring again to FIGS. 4-8, the positioning of the processing belt 10 serves to define the processing chamber 14. Additionally, the location of the processing belt 10 can also define the interstitial area 180 of the interior 20 of the cabinet 18, that can hold various operating mechanisms and service spaces for the laundry appliance 12. In particular, the machine compartment 24 is included within this interstitial area 180. The machine compartment 24 can include a blower 182 for moving process air 184 through an airflow path 186 for the laundry appliance 12. The machine compartment 24 can also include a heater 188 or any one of various heat exchange mechanisms that can be used to vary the temperature of the process air 184 as it moves through the airflow path 186. The machine compartment 24 can also include a fluid system 190 that provides for the draining of fluids 192 from the laundry appliance 12. These fluids 192 can include condensate, washing fluids, fluids extracted from articles of laundry 16 and other similar fluids 192 that may be drained from the laundry appliance 12. This fluid system 190 can also include various sprayers 194 and fluid conduits for delivering various fluids 192 into the processing chamber 14. These sprayers 194 can be included within the sidewalls 46 for the cabinet 18, within a top wall 44 for the cabinet 18, and other similar locations that are convenient for delivering fluid 192 into the processing chamber 14.

According to various aspects of the device, the processing belt 10 can include a porous structure that allows for fluid 192 to pass through the processing belt 10 and into the processing chamber 14, or vice versa, during a draining operation. Process air 184 can also pass through the porous structure of the processing belt 10 during operation of the blower 182 and the appliance 12 generally.

As exemplified in FIGS. 7-8 and 15-16, the lower portion 36 of the interior 20 can include a basin 210 that holds a volume of process fluid 212 therein for performing various laundry operations upon articles of laundry 16 contained within the processing chamber 14. Typically, the processing belt 10 includes an at least partially porous structure that allows for the processing belt 10 to move through the basin 210 and the process fluid 212 such that articles of laundry 16 can be manipulated by the translation of the processing belt 10 to move through the volume of process fluid 212 contained within the basin 210. As this occurs, the process fluid 212 is permitted to pass through the various portions of the processing belt 10 so that the various fluids 192 can be injected into and drained from the processing chamber 14. The basin 210 can include a fluid shield 220 that extends under the processing belt 10, and over the machine compartment 24 to define a bottom of the basin 210, and also separate the basin 210 from other operational components of the laundry appliance 12. In various aspects of the device, the tumbling portion 30 and the return portion 32 of the processing belt 10 will pass through the basin 210 and the processing fluid 192 contained therein during various cycles of the laundry appliance 12. It is also contemplated that only the tumbling portion 30 of the processing belt 10 may pass through the basin 210 and the processing fluid 192 contained therein.

Referring again to FIGS. 1-16, the laundry appliance 12 described herein having the processing belt 10 can be a washing appliance, a drying appliance, or a combination washing and drying appliance. During a washing cycle of a washing appliance or a combination washing and drying appliance, the fluid system 190 for the appliance 12 delivers various process fluids 212 and laundry chemistries into the processing chamber 14 for treating articles of laundry 16. These process fluids 212 are typically contained within the basin 210 and the processing belt 10 is configured to pass through this basin 210 to move the articles of laundry 16 through the basin 210, such as in one or more of the agitating conditions 100. As discussed above, the fluid path 230 for the appliance 12 can include various sprayers 194 that dispose these fluids 192 within the processing chamber 14. In various aspects of the device, the fluid system 190 for the appliance 12 can include a fluid path 230 that extends through the processing belt 10. In such an embodiment, the fluid 192 can pass through the various porous structures of the processing belt 10 to dispose the processing fluid 192 within the basin 210. It is also contemplated that the fluid path 230 can include various sprayers 194 that are positioned within portions of the processing chamber 14 that are distal from the processing belt 10. As discussed above, these locations can include, but are not limited to, a top wall 44 and sidewalls 46 of the cabinet 18 for the appliance 12. It is also contemplated that the porous structures of the processing belt 10 allow for process air 184 to pass therethrough for drying articles of laundry 16 contained within the processing chamber 14.

During a washing operation, the processing belt 10 is used to agitate the articles of laundry 16 within the processing chamber 14. To assist in moving the articles of laundry 16 within the processing chamber 14, the processing belt 10 can include various friction-type surfaces 240 that assist in the movement of the articles of laundry 16 within the processing chamber 14. These friction-type surfaces 240 can include, but are not limited to, cleats or other outwardly extending structures, textured surfaces of the processing belt 10, coatings disposed on the processing belt 10 (such as silicone, rubberized surfaces, and other similar gripping-type surfaces). These friction-type surfaces 240 of the processing belt 10 serve to manipulate the articles of laundry 16 during the washing operation with minimal sliding. In this manner, the articles of laundry 16 mix within the processing fluid 192 within the basin 210. These textured surfaces also provide for a tumbling-movement of the articles of laundry 16 within the processing chamber 14.

According to various aspects of the device, the laundry appliance 12 can include various dispensing systems for dispensing laundry chemistries into the processing chamber 14. These laundry chemistries can be disposed within the processing chamber 14 along with other fluids 192, such as water, during various portions of the washing operation. At the completion of a particular washing operation, the processing fluid 192 contained within the basin 210, and within other portions of the processing chamber 14 can be drained from the processing chamber 14. As discussed above, this draining operation typically occurs by allowing the process fluid 212 to pass through portions of the processing belt 10, and through a drain 250 that removes the fluid 192 from the basin 210 and out of the appliance 12. As discussed above, the mechanical features of the appliance 12 are typically positioned within the machine compartment 24 or other interstitial areas 180 that are located behind and beneath the processing belt 10.

As exemplified in FIGS. 1-16, in a drying appliance or a combination washing and drying appliance, a drying operation is performed by passing process air 184 through an airflow path 186. This airflow path 186 typically extends through the machine compartment 24, and then through portions of the processing chamber 14. The directional flow of the airflow path 186 through the processing chamber 14 can vary and can depend upon the exact configuration of the laundry appliance 12. By way of example, and not limitation, an air inlet 260 and air outlet 262 for the airflow path 186 within the processing chamber 14 can be located at the opposing sidewalls 46 of the cabinet 18. The air inlet 260 and air outlet 262 for the processing chamber 14 can also be located within the top wall 44 and a front wall 264 of the cabinet 18, near the aperture 82 for the door 42. Combinations of these two configurations can also be contemplated within various designs of the laundry appliance 12. It is also contemplated that the airflow path 186 can extend through the processing belt 10 such that process air 184 is moved through the processing belt 10 and into the processing chamber 14 and directly into articles of laundry 16 that are positioned against the tumbling portion 30 of the processing belt 10.

Figure 6:
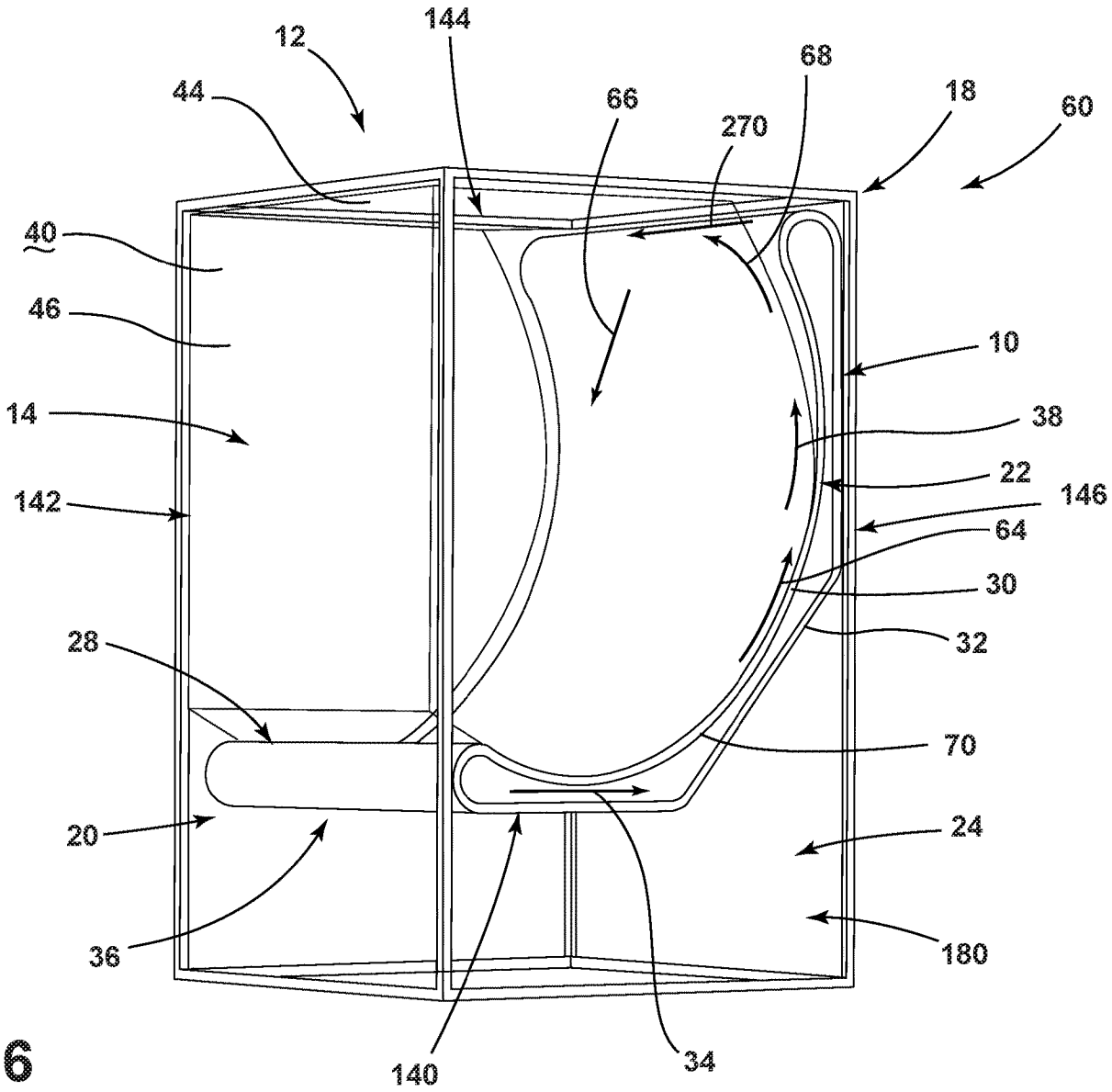
FIG. 6 is a schematic perspective view of an aspect of the processing belt for the laundry appliance.
Figure 7:
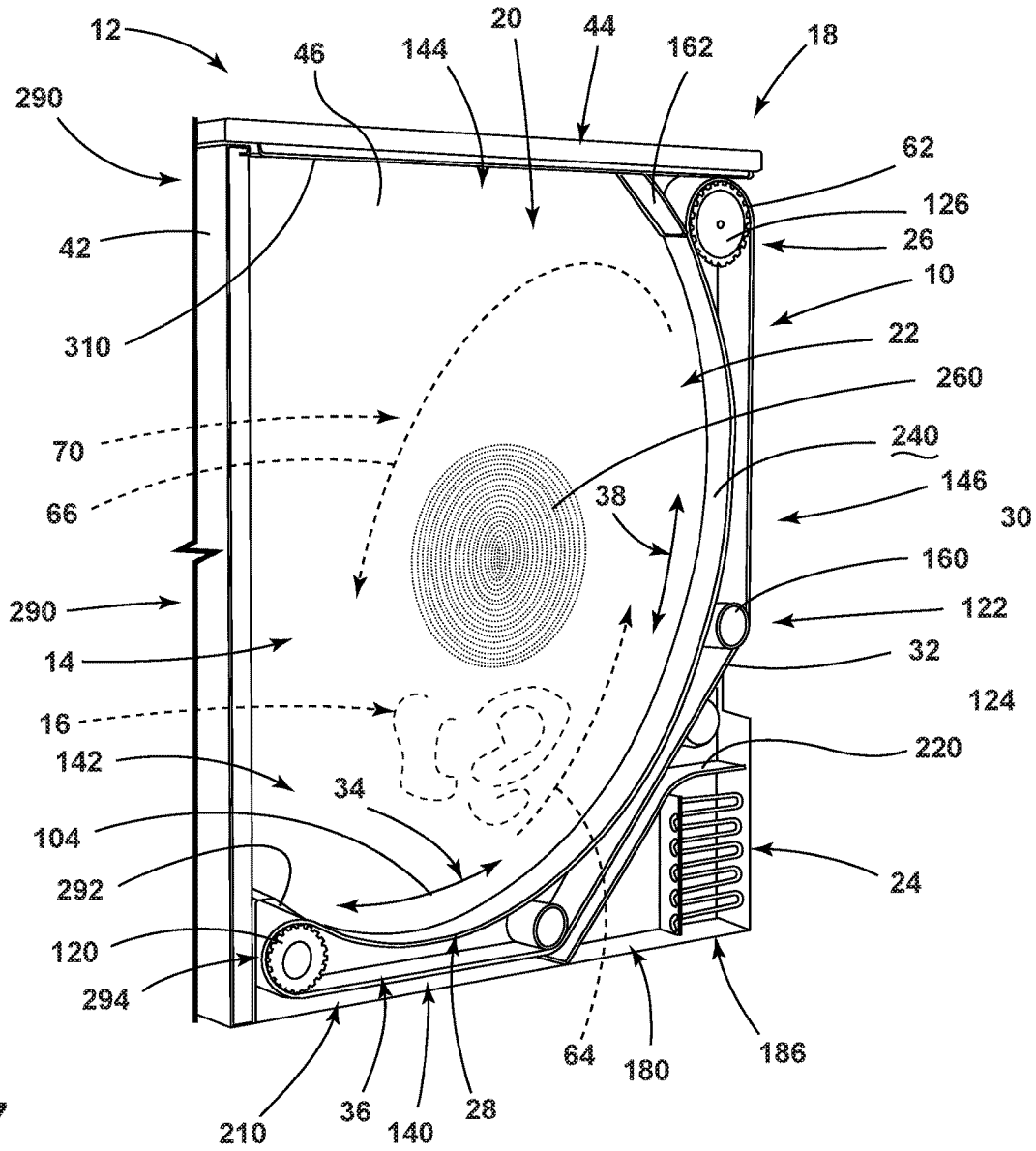
FIG. 7 is a cross-sectional perspective view of the laundry appliance of FIG. 1 taken along line VII-VII and showing the operating path for the processing belt.
Figure 8:
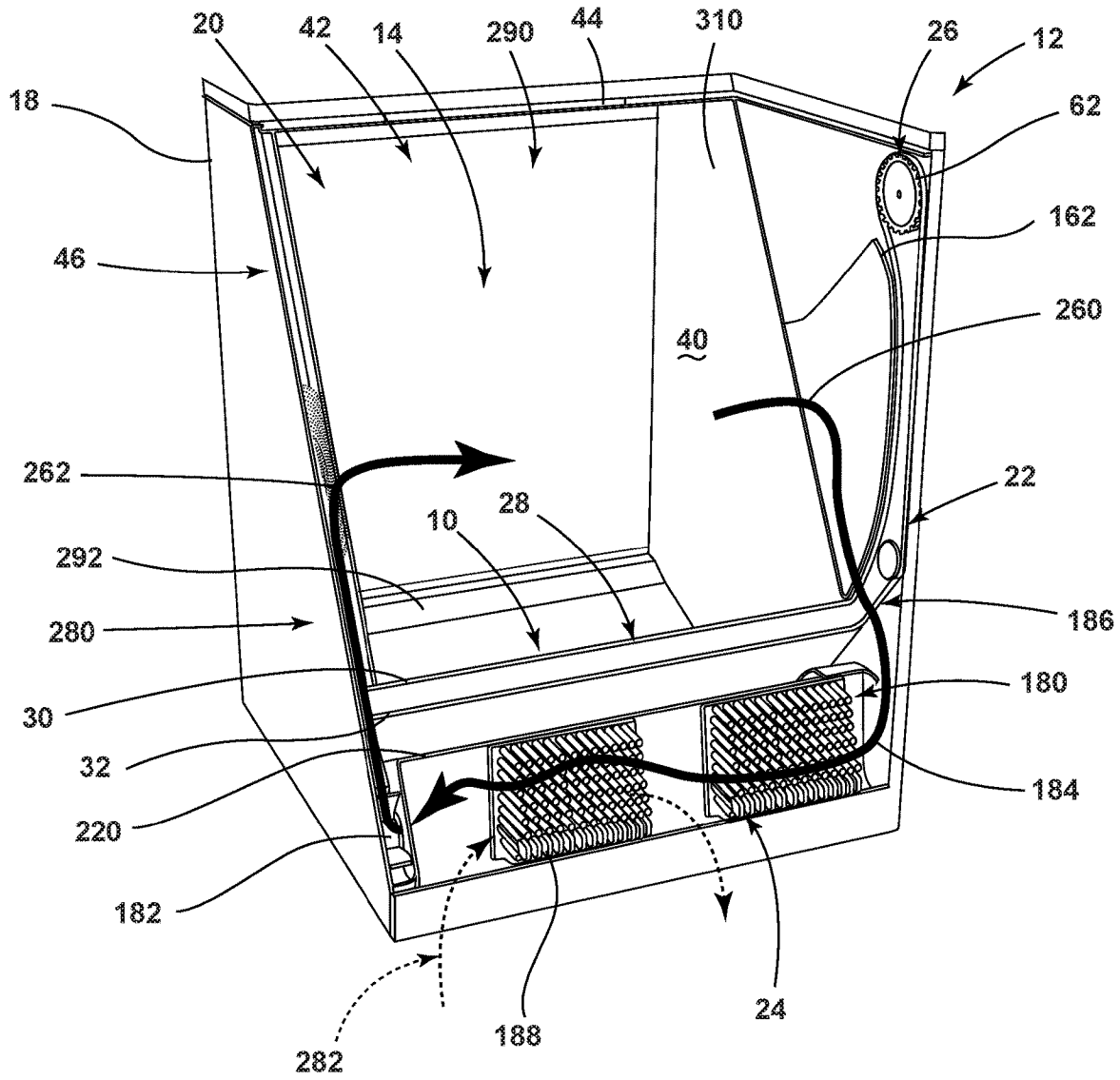
FIG. 8 is a perspective cross-sectional view of an aspect of the laundry appliance incorporating a processing belt and showing the configuration of the processing chamber and the machine compartment for the appliance.
Figure 9:
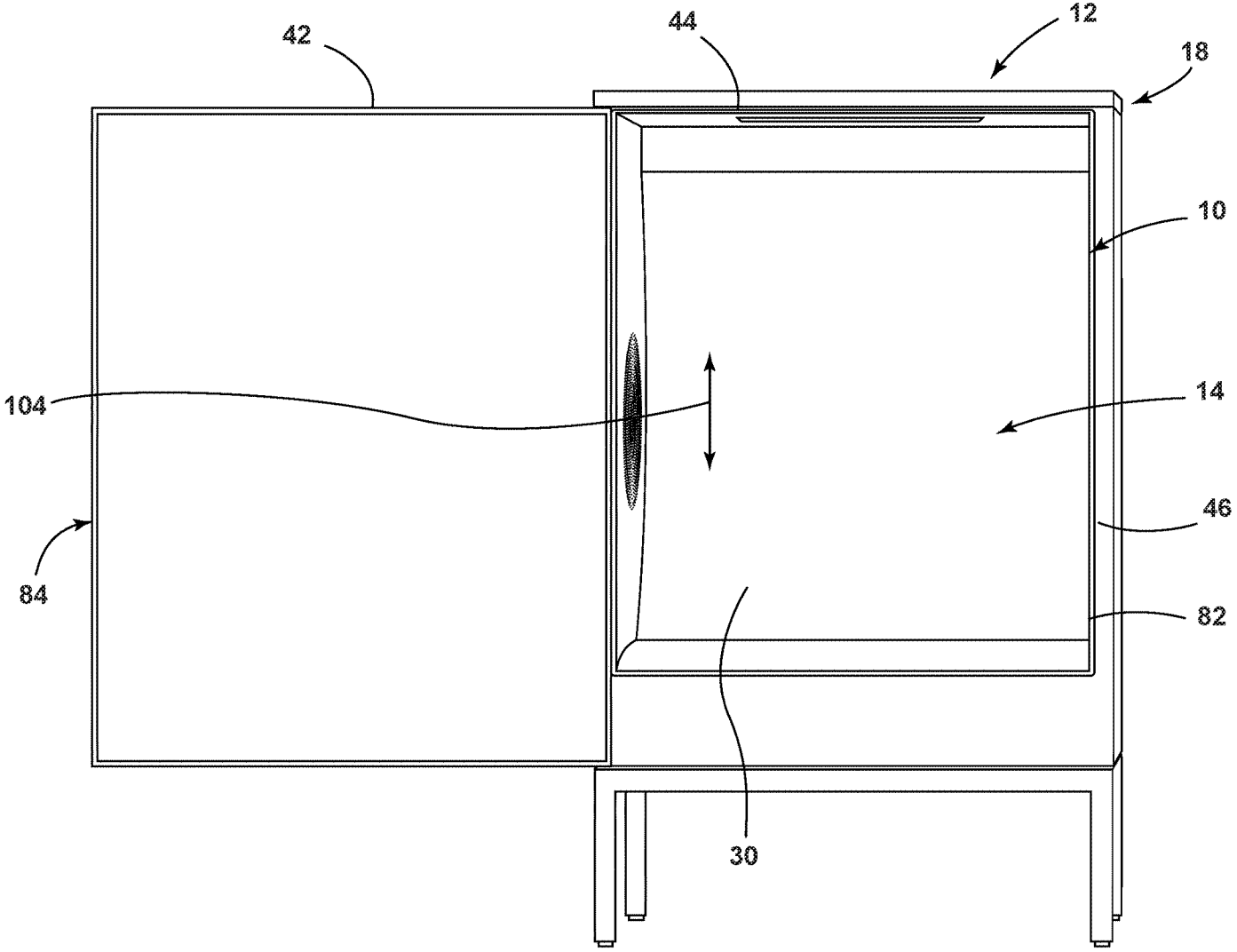
FIG. 9 is a front perspective view of the laundry appliance of FIG. 1.
Figure 10:
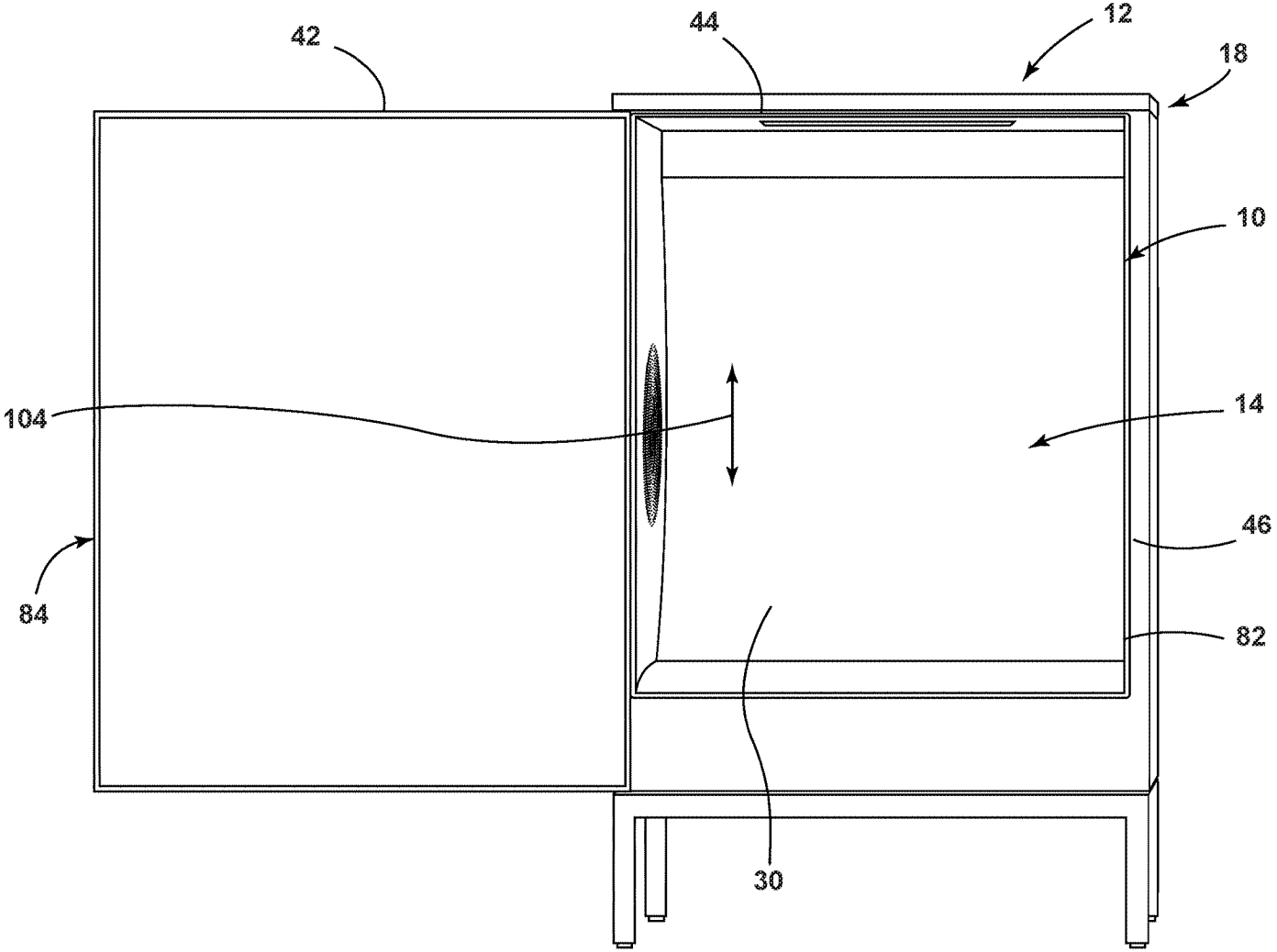
FIG. 10 is a front perspective view of the laundry appliance of FIG. 9.
Figure 11:
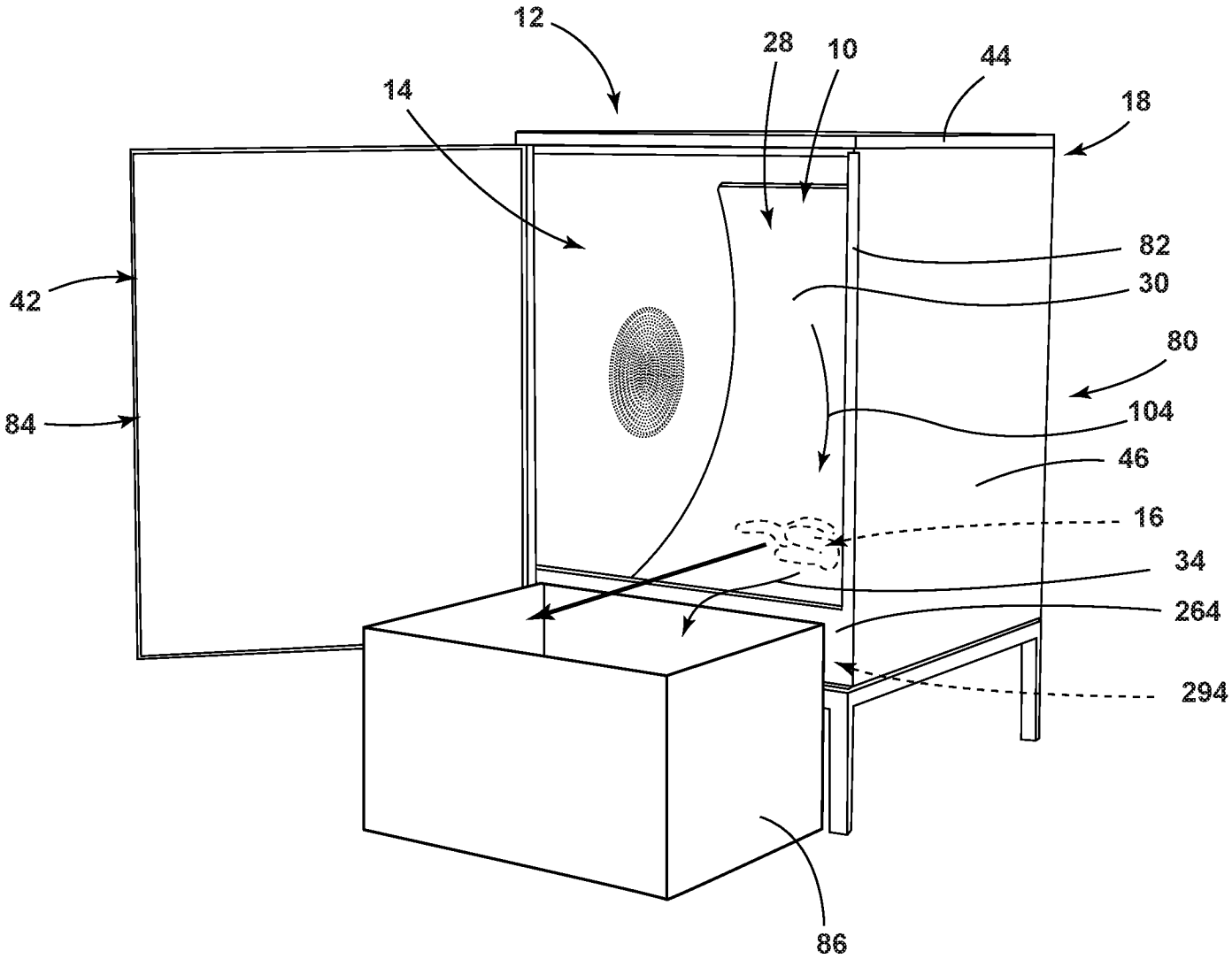
FIG. 11 is a schematic perspective view of the laundry appliance of FIG. 1 and showing operation of an unload condition for the laundry appliance.
Figure 12:
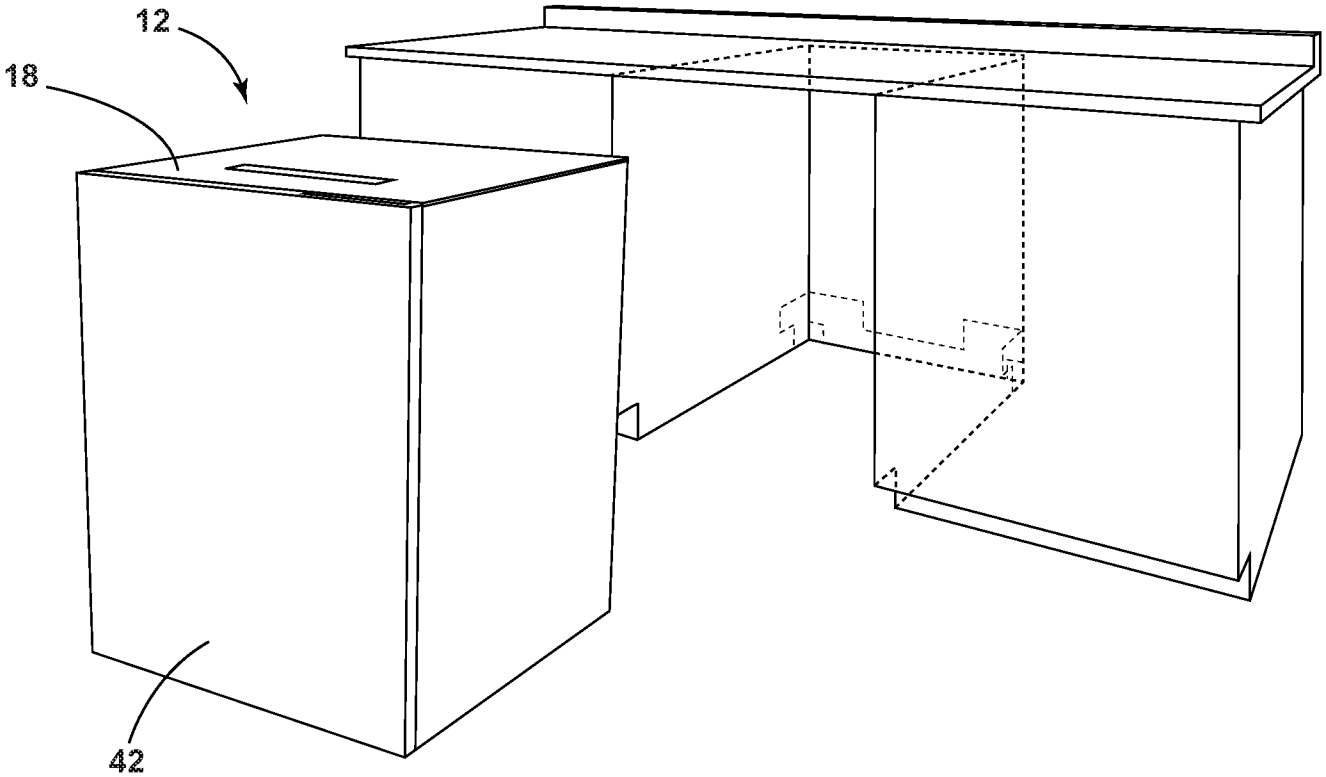
FIG. 12 is a schematic perspective view of an aspect of the laundry appliance showing placement of the laundry appliance within a section of millwork.
Figure 13:
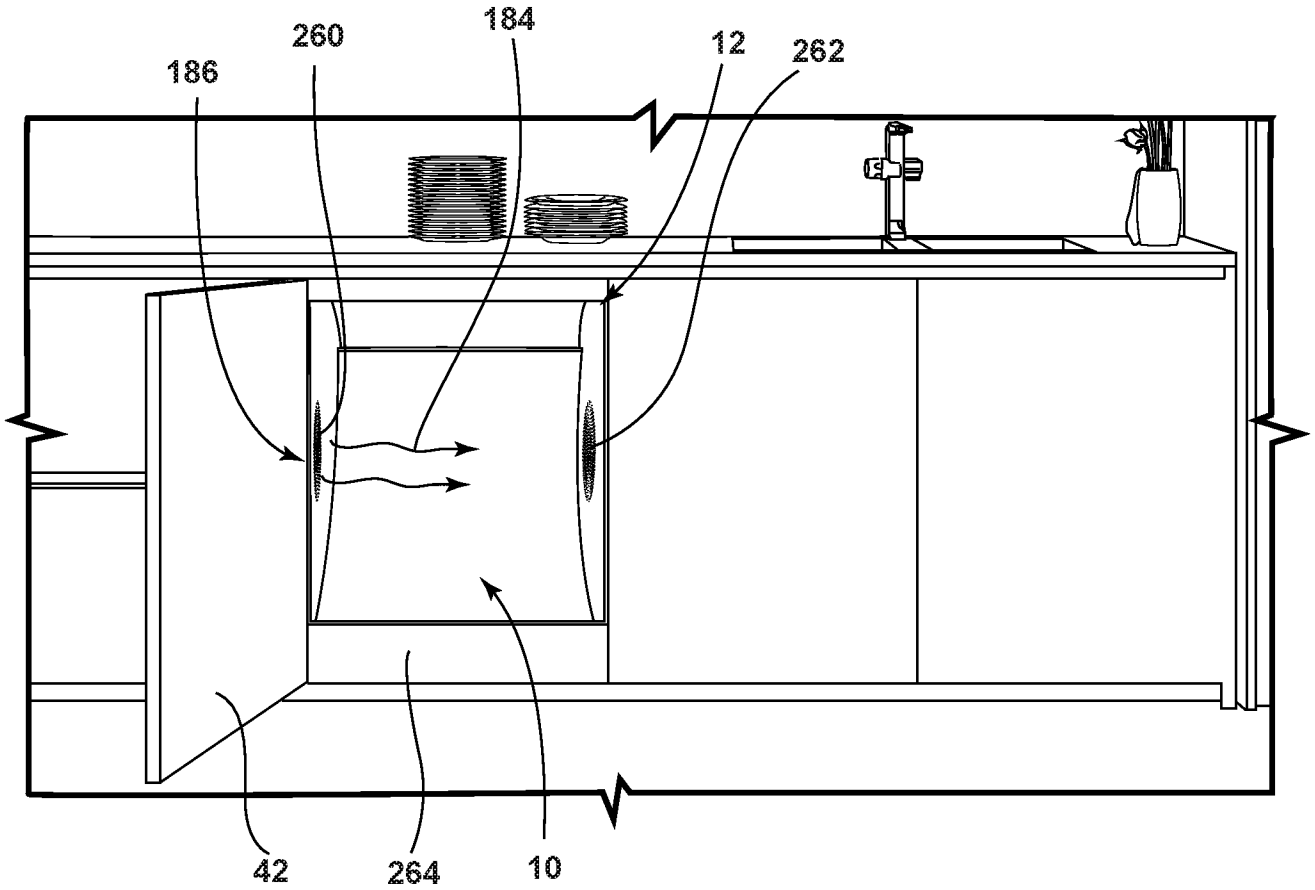
FIG. 13 is a front perspective view of an aspect of the laundry appliance shown within a section of millwork.
Figure 14:
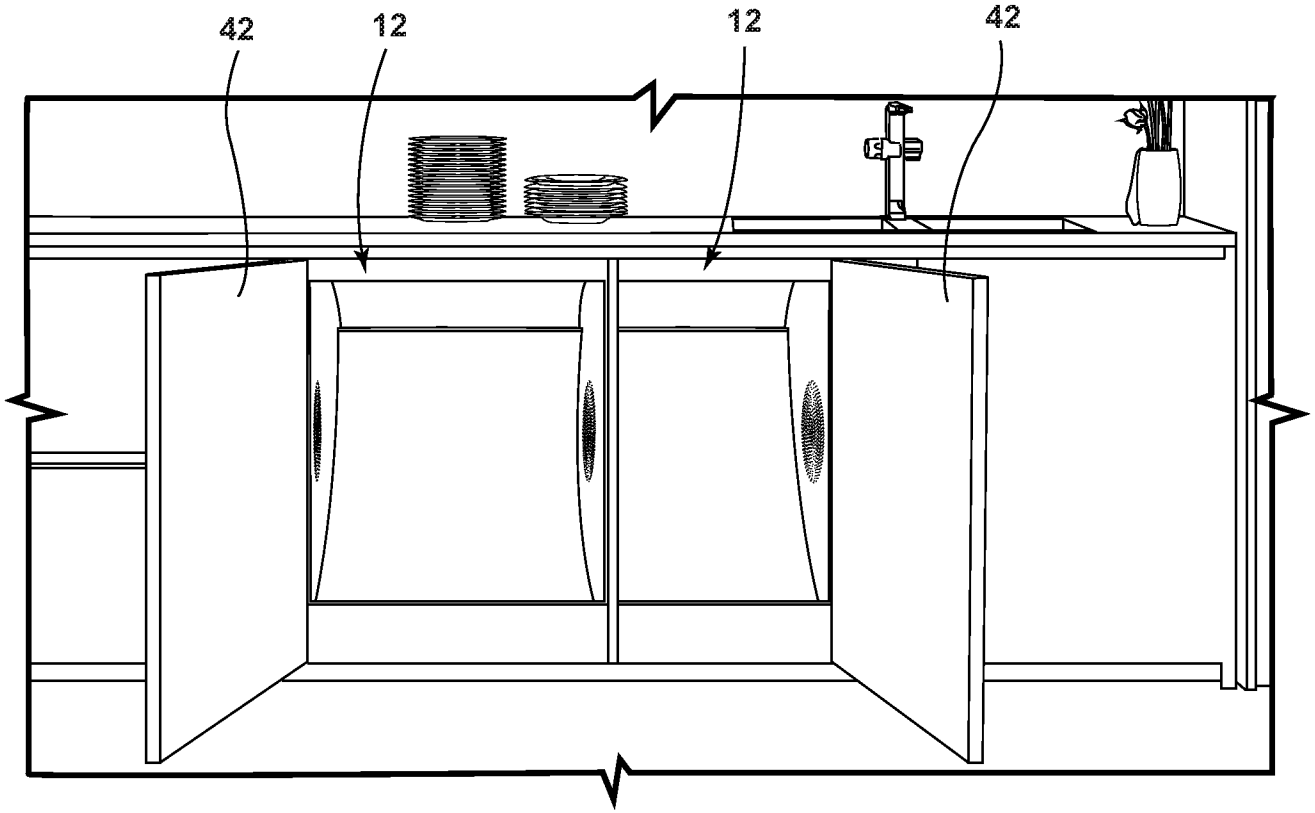
FIG. 14 is a front perspective view of a pair of laundry appliances that incorporate aspects of the processing belt and shown within a section of millwork.

As exemplified in FIG. 6, the airflow path 186 for the laundry appliance 12 can assist in drying the articles of laundry 16 and also moving the articles of laundry 16 within the processing chamber 14. As a non-limiting example, a stream 270 of process air 184 can be projected near a top portion 144 of the interior 20 and near the processing belt 10 and into the processing chamber 14. This stream 270 of process air 184 can be used to push articles of laundry 16 forwards within the processing chamber 14. In this configuration, the stream 270 of process air 184 helps to promote the tumbling motion 70 of the articles of laundry 16 within the processing chamber 14. In another non-limiting example, the process air 184 can be moved from the processing chamber 14 and through the processing belt 10 such that the movement of process air 184 may at least partially push the articles of laundry 16 against the tumbling portion 30 of the processing belt 10. These movements of process air 184 through the processing chamber 14, as discussed above, serve to promote the tumbling motion 70 of articles of laundry 16 within the processing chamber 14 to allow process air 184 to pass within, through and around the articles of laundry 16 contained therein.

The laundry appliance 12, when used for a drying operation, can include the heater 188, a heat exchanger, a heat pump system, a condensate system, or other similar drying mechanism for modifying the temperature of the process air 184 and also extracting moisture from the process air 184. Additionally, the airflow path 186 for the laundry appliance 12 can include a recirculating system 280 that continually recycles process air 184 through the processing chamber 14 and then through various heaters 188 and heat exchangers for extracting moisture therefrom and modifying the temperature of this process air 184. The airflow path 186 can also include a vented system 282 that vents process air 184 out of the laundry appliance 12, and typically out of the structure contained in the appliance 12. In the case of certain heat exchange systems, the laundry appliance 12 can include a combination of the recirculating system 280 and a vented system 282. Such a system may be used in a condensate dryer where an air-to-air heat exchanger is implemented for changing the temperature of the process air 184 and also extracting condensate from the process air 184.

Referring again to FIGS. 4-11, upon completion of a laundry cycle within the laundry appliance 12, the articles of laundry 16 may be removed from the processing chamber 14. Removal of the articles of laundry 16 can be accomplished through the unload condition 80 of the processing belt 10. During operation of the processing belt 10 when the door 42 is in a closed position 290, the door 42 can include a deflector 292 that prevents articles of laundry 16 from passing into or under a switchback portion 294 of the processing belt 10. This switchback portion 294 is typically located around the idler wheel 120 and can be located proximate the door 42 within a front portion 142 of the interior 20 for the appliance 12. This deflector 292 is positioned over the switchback portion 294 so that articles of laundry 16 cannot be trapped between the door 42 and the switchback portion 294 of the processing belt 10. When the door 42 is moved to the open position 84, the deflector 292, which can be attached to the door 42, can be moved out of the way such that the switchback portion 294 is exposed to the door aperture 82 of the appliance 12. In this configuration, the switchback portion 294 assists in projecting articles of laundry 16 out of the processing chamber 14 and through the door aperture 82 for the appliance 12. It is also contemplated that the deflector 292 may be in position during the unload condition 80, such that the movement of the processing belt 10 in the unload condition 80 provides a sufficient momentum of the articles of laundry 16 to be pushed over the deflector 292 and into a basket 86 outside of the appliance 12.

Referring again to FIGS. 1-16, the configuration of the laundry appliance 12 having a processing belt 10 provides for a greater processing space within the volume of the cabinet 18. The processing belt 10, only being located within the lower portion 36 of the interior 20 and the rear portion 22 of the interior 20, provides for the entire top and front portions 144, 142 of the cabinet 18 to be used as the processing chamber 14. Additionally, the flexible configuration of the processing belt 10 can be positioned by the drive train 26 to extend through the interior 20 of the cabinet 18 in a non-circular configuration.

As discussed above, the shape exemplified in FIGS. 4-7 is a generally elliptical shape of the processing belt 10 and the processing chamber 14. By way of example, and not limitation, within a standard sized cabinet 18 for a laundry appliance 12, 7.2 cubic feet of space is available within the processing chamber 14 of the laundry appliance 12 using the processing belt 10. Accordingly, approximately three quarters of the interior 20 for the cabinet 18 is devoted to the processing chamber 14. Additionally, because the processing belt 10 does not occupy front portions 142 of the interior 20 for the laundry appliance 12, the entire front wall 264 of the laundry appliance 12 can define a door aperture 82 for accessing the processing chamber 14. Accordingly, the opening for accessing the processing chamber 14 can be approximately four square feet in area.

Within conventional laundry machines, the interior volume of a processing space can include 2.3 cubic feet of processing space, even in larger platform machines. The 3.2 cubic feet may be only one-fifth of the volume defined within the outer cabinet for the laundry machines. Similarly, the access aperture for these conventional machines may be only 1.4 square feet in area. Again, this is the case for machines of varying sizes and capacities.

When comparing the disclosed design for the laundry appliance 12 incorporating the processing belt 10 against prior conventional machines, the laundry appliance 12 having the processing belt 10 provides approximately three times greater capacity, without increasing, and in some cases, by decreasing the overall size of the outer cabinet 18. Additionally, the aperture 82 for the door 42 of the laundry appliance 12 having the processing belt 10 is also approximately three times larger than that of conventional machines. These differences and increases in dimensional capacities between the disclosed appliance 12 having the processing belt 10 and conventional machines are made even greater when multiple appliances 12 are used in combination, as exemplified in FIGS. 2, 3 and 14. Again, these advantages are realized even when the appliance 12 incorporating the processing belt 10 is decreased in size.

In addition to these dimensional differences, the laundry appliance 12 that includes the processing belt 10 does not include a rotating drum within an enclosed tub that is then positioned within an outer cabinet 18. Conversely, the device having the processing belt 10 includes an outer cabinet 18 and the processing belt 10 contained therein. Certain inner panels 310 are contained within the cabinet 18 for the laundry appliance 12 to provide interstitial areas 180 for moving air and fluid 192 between the machine compartment 24 and the processing chamber 14. Moreover, the laundry appliance 12 that includes the processing belt 10 does not include the extensive balancing features and damping features that are contained within conventional machines. These advantages of the laundry appliance 12 having the processing belt 10 result in a laundry appliance 12 that can be made with fewer resources and potentially lesser cost and having a larger capacity.

Figure 17:
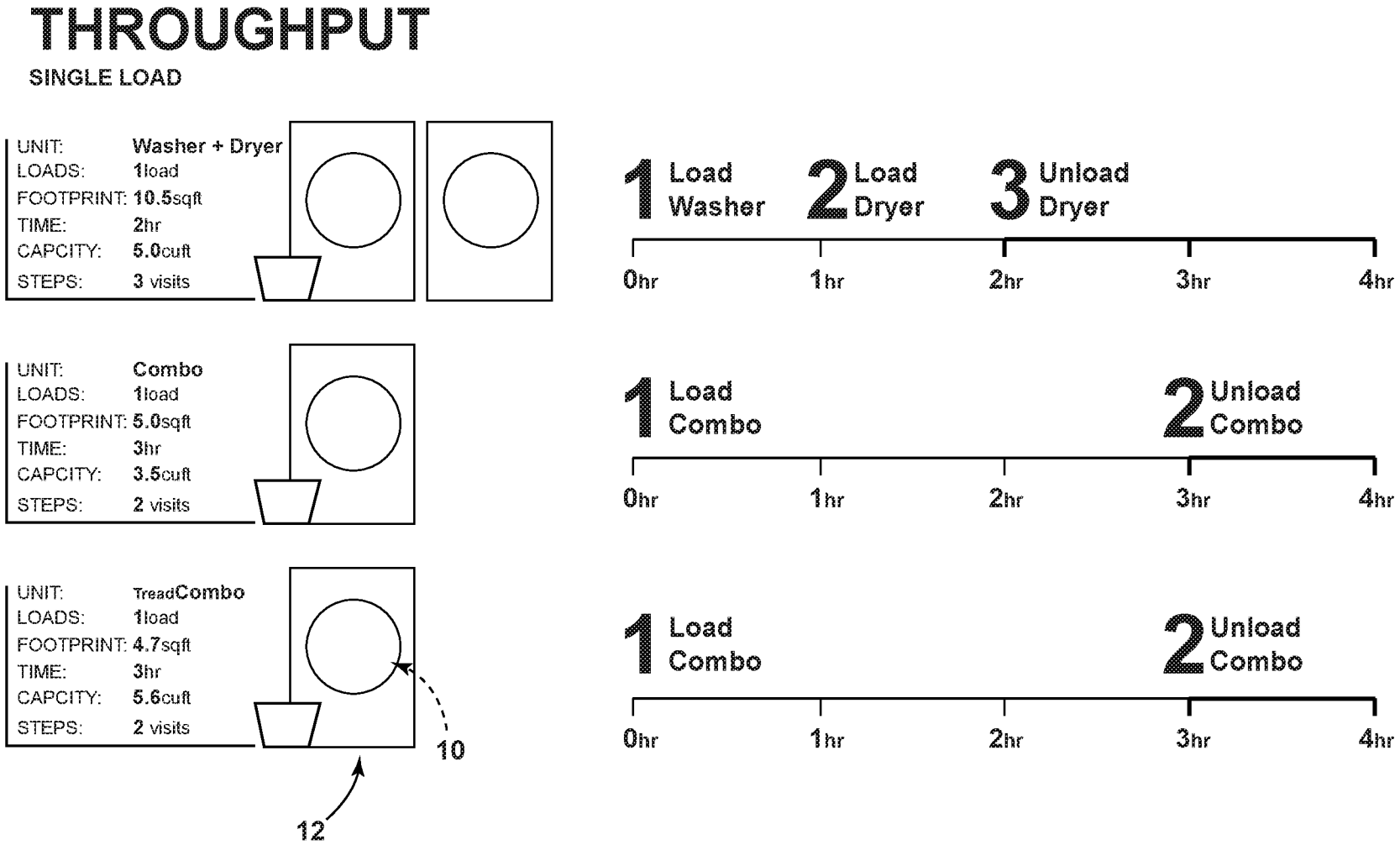
FIG. 17 is a schematic diagram illustrating a comparison of laundry throughput and comparing a single load being processed by a washer and dryer machine pair, a conventional combination machine and the laundry appliance incorporating an aspect of the processing belt.
Figure 18:
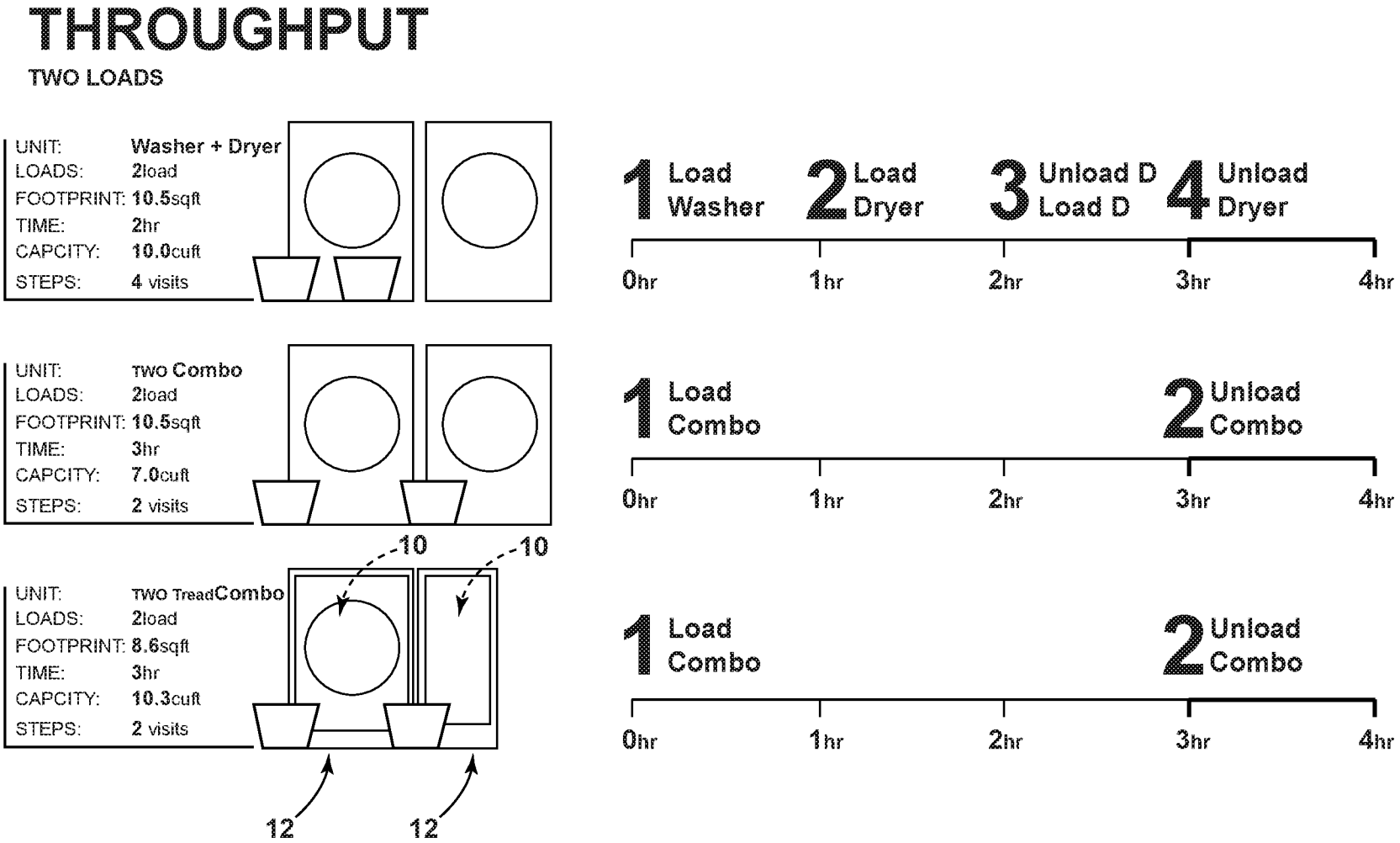
FIG. 18 is a schematic diagram illustrating a laundry throughput for two loads with respect to a washer and dryer machine pair, two conventional combination machines, and two laundry appliances that incorporate aspects of the processing belt.

Referring now to FIGS. 17 and 18, testing has been done to compare the laundry appliance 12 having the processing belt 10 against conventional washer and dryer machines and combination washing/drying machines. These studies have been conducted with respect to a single load of articles of laundry 16 and two loads of articles of laundry 16.

As exemplified in FIG. 17, treating a single load of laundry 16 typically takes approximately two hours within a washer and dryer machine pair. This time is increased within a conventional combination washer/dryer machine by one hour. For the appliance 12 having the processing belt 10, the time for treating the single load is similar to that of a combination washing and drying machine for a single load. However, the advantages are achieved by using the laundry appliance 12 having the processing belt 10 as the appliance 12 includes a smaller footprint and a capacity that is over double the combined capacities of the washer and dryer machine pair and almost double the capacity of the combination washing/drying machine.

With respect to FIG. 18, these advantages are greater when multiple loads are being processed. As exemplified in FIG. 18, the time needed to wash two loads is identical among the washer and dryer machine pair, the combination washing/drying machine and the laundry appliance 12 having the processing belt 10. According to FIG. 18, these time comparisons were conducted with a washer and dryer machine pair, a pair of combination washing/drying machines, and a pair of laundry appliances 12 having processing belts 10. It is worth noting that these tests were conducted with the appliance 12 having the processing belt 10 of different sizes to provide a smaller overall footprint. The same advantages that were experienced by the appliance 12 having the processing belt 10 are again achieved through the appearance of a smaller overall footprint and a much larger overall capacity. Similarly, larger overall capacities and dimensional tolerances can be achieved with the appliance 12 having the processing belt 10, even where the overall footprint and overall size of the appliance 12 is smaller than conventional laundry machines.

Figure 15:
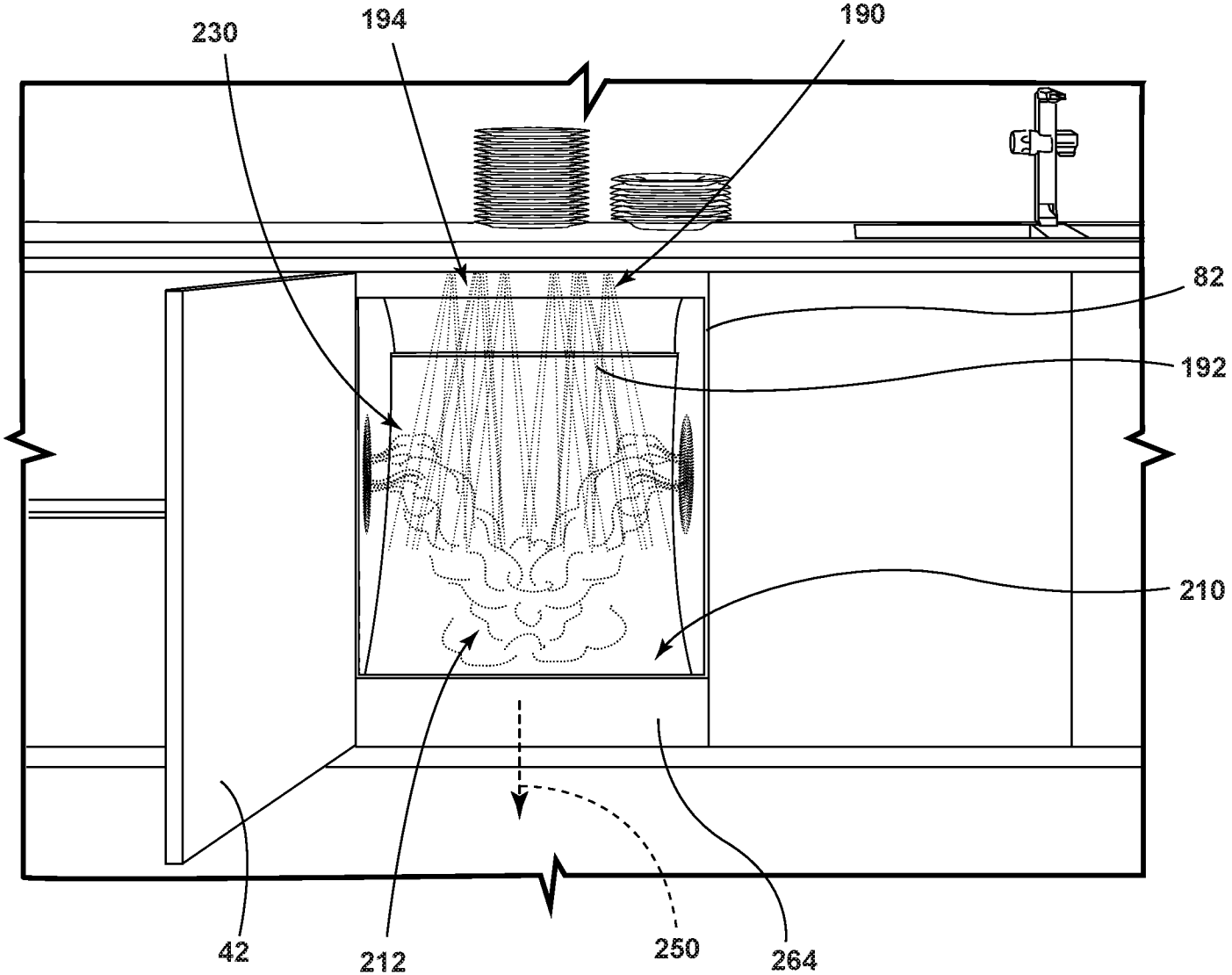
FIG. 15 is a front perspective view of a laundry appliance and showing an exemplary spray pattern for the laundry appliance.
Figure 16:
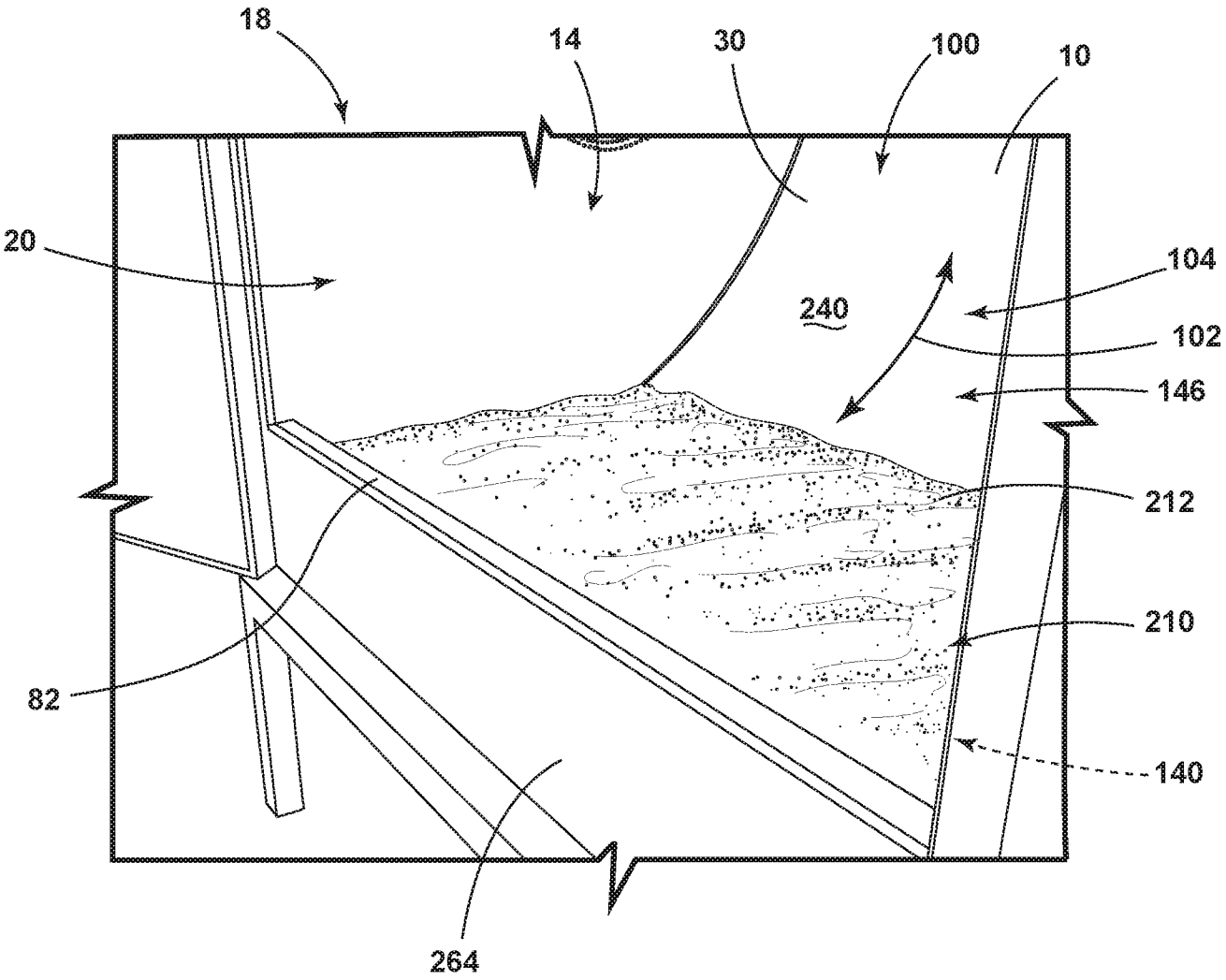
FIG. 16 is a front perspective view of an aspect of the laundry appliance and showing the basin for accumulating process fluid for use within the laundry appliance.

As exemplified in FIG. 15, the fluid system 190 for the laundry appliance 12 having the processing belt 10 can include various fluid inputs or sprayers 194 that are contained within stationary walls of the cabinet 18. Accordingly, minimal gaskets and sealing configurations are needed, and no particularly complex sprayers 194 are required for injecting water through other moving parts. Stated another way, within the laundry appliance 12, the processing belt 10 can be positioned within various stationary portions of the interior 20 and interfaces for the movement of the fluid 192 and process air 184 can also be positioned in stationary portions of the laundry appliance 12, such as the sidewalls 46, top walls 44, front walls 264, and other stationary portions.

As discussed above, the drive train 26 for the laundry appliance 12 can include the opposing guide rails 162 that maintain the operational path 28 for the processing belt 10. These guide rails 162 also provide a guard against clothing being lodged between the processing belt 10 and portions of the cabinet 18. These guide rails 162 direct articles of laundry 16 back into the interior portions of the processing chamber 14 so that articles of laundry 16 can be manipulated through the translation of the processing belt 10 within the processing chamber 14.

According to another aspect of the present disclosure, a laundry appliance includes a cabinet defining an interior. A processing chamber is defined within the interior. A processing belt partially defines the processing chamber and translates vertically within the interior.

According to another aspect, the processing belt defines a rearward boundary of the processing chamber.

According to yet another aspect, a machine compartment positioned within the interior, wherein the processing belt separates the machine compartment from the processing chamber.

According to another aspect of the present disclosure, a drive train defines an operational path of the processing belt. A tumbling portion of the operational path defines a portion of the processing chamber. A return portion of the operational path is positioned distal from the processing chamber.

According to another aspect, an inside surface of a door and opposing sidewalls of the cabinet further define the processing chamber.

According to yet another aspect, the processing belt is operational in a tumbling condition that directs the tumbling portion of the processing belt away from a door aperture of the cabinet.

According to another aspect of the present disclosure, the processing belt is operational in an unload condition that directs the tumbling portion of the processing belt toward a door aperture. The unload condition is further defined by a door being in an open position relative to the door aperture.

According to another aspect, a blower directs process air through an airflow path that extends between the machine compartment to the processing chamber.

According to yet another aspect, the airflow path extends through the processing chamber from an air inlet disposed within a sidewall of the cabinet.

According to another aspect of the present disclosure, the airflow path extends from the air inlet to an air outlet disposed within at least one of a front wall and an opposing sidewall of the cabinet.

According to another aspect, the processing belt is a porous structure that allows fluid and air to pass therethrough.

According to yet another aspect, a laundry appliance includes a cabinet defining a processing chamber within an interior. A processing belt is positioned between opposing sidewalls of the cabinet and partially defines the processing chamber. The processing belt translates vertically within the interior to define a rear portion of the processing chamber.

According to another aspect of the present disclosure, the processing belt is operable in a tumbling condition that operates the processing belt in a single direction, and wherein the processing belt is operable in an agitation condition that includes a reciprocal motion of the processing belt within the processing chamber.

According to another aspect, a machine compartment is positioned within the interior. The processing belt partially separates the machine compartment from the processing chamber. A drive train defines an operational path of the processing belt. A tumbling portion of the operational path defines a portion of the processing chamber. A return portion of the operational path is positioned distal from the processing chamber.

According to yet another aspect, the processing belt is operational in an unload condition that directs the tumbling portion of the processing belt toward a door aperture. The unload condition is further defined by a door being in an open position.

According to another aspect of the present disclosure, a bottom of the processing chamber includes a basin that holds a volume of process fluid. At least the tumbling portion of the belt translates through the basin.

According to another aspect, the processing belt is a porous material that allows fluid and air to pass therethrough.

According to yet another aspect, a laundry appliance includes a cabinet defining an interior. A processing chamber is defined within the interior. A processing belt partially defines the processing chamber and translates vertically within the interior. A machine compartment is positioned within the interior. The processing belt partially separates the machine compartment from the processing chamber. A drive train defines an operational path of the processing belt. A tumbling portion of the operational path defines a portion of the processing chamber and a return portion of the operational path is positioned distal from the processing chamber.

According to another aspect of the present disclosure, the processing belt is a porous material that allows fluid and air to pass therethrough.

According to another aspect, a fluid path and an airflow path extends through the processing chamber. At least one of the fluid path and the airflow path extends through the processing chamber and extends through the processing belt.

It will be understood by one having ordinary skill in the art that construction of the described disclosure and other components is not limited to any specific material. Other exemplary embodiments of the disclosure disclosed herein may be formed from a wide variety of materials, unless described otherwise herein.

For purposes of this disclosure, the term "coupled" (in all of its forms, couple, coupling, coupled, etc.) generally means the joining of two components (electrical or mechanical) directly or indirectly to one another. Such joining may be stationary in nature or movable in nature. Such joining may be achieved with the two components (electrical or mechanical) and any additional intermediate members being integrally formed as a single unitary body with one another or with the two components. Such joining may be permanent in nature or may be removable or releasable in nature unless otherwise stated.

It is also important to note that the construction and arrangement of the elements of the disclosure as shown in the exemplary embodiments is illustrative only. Although only a few embodiments of the present innovations have been described in detail in this disclosure, those skilled in the art who review this disclosure will readily appreciate that many modifications are possible (e.g., variations in sizes, dimensions, structures, shapes and proportions of the various elements, values of parameters, mounting arrangements, use of materials, colors, orientations, etc.) without materially departing from the novel teachings and advantages of the subject matter recited. For example, elements shown as integrally formed may be constructed of multiple parts or elements shown as multiple parts may be integrally formed, the operation of the interfaces may be reversed or otherwise varied, the length or width of the structures and/or members or connector or other elements of the system may be varied, the nature or number of adjustment positions provided between the elements may be varied. It should be noted that the elements and/or assemblies of the system may be constructed from any of a wide variety of materials that provide sufficient strength or durability, in any of a wide variety of colors, textures, and combinations. Accordingly, all such modifications are intended to be included within the scope of the present innovations. Other substitutions, modifications, changes, and omissions may be made in the design, operating conditions, and arrangement of the desired and other exemplary embodiments without departing from the spirit of the present innovations.

It will be understood that any described processes or steps within described processes may be combined with other disclosed processes or steps to form structures within the scope of the present disclosure. The exemplary structures and processes disclosed herein are for illustrative purposes and are not to be construed as limiting.

What is claimed is:

1. A laundry appliance comprising:

a cabinet defining an interior and having a front wall with a door aperture;

a processing chamber defined within the interior; and a processing belt that partially defines the processing chamber and translates vertically within the interior, wherein a front portion of the processing chamber is defined by the front wall and the door aperture and a rear portion of the processing chamber is defined by the processing belt.

2. The laundry appliance of claim 1, wherein the processing belt defines a rearward boundary of the processing chamber.

3. The laundry appliance of claim 1, further comprising:

a machine compartment positioned within the interior, wherein the processing belt separates the machine compartment from the processing chamber.

4. The laundry appliance of claim 1, further comprising:

a drive train that defines an operational path of the processing belt, wherein a tumbling portion of the operational path defines a portion of the processing chamber and a return portion of the operational path is positioned distal from the processing chamber.

5. The laundry appliance of claim 1, wherein a door selectively engages the door aperture in a closed position, and wherein an inside surface of the door in the closed position and opposing sidewalls of the cabinet further define the processing chamber.

6. The laundry appliance of claim 4, wherein the processing belt is operational in a tumbling condition that directs the tumbling portion of the operational path of the processing belt away from the door aperture of the cabinet.

7. The laundry appliance of claim 4, wherein the processing belt is operational in an unload condition that directs the tumbling portion of the operational path of the processing belt toward the door aperture, wherein the unload condition is further defined by a door being in an open position relative to the door aperture.

8. The laundry appliance of claim 3, further comprising a blower that directs process air through an airflow path that extends between the machine compartment to the processing chamber.

9. The laundry appliance of claim 8, wherein the airflow path extends through the processing chamber from an air inlet disposed within a sidewall of the cabinet.

10. The laundry appliance of claim 9, wherein the airflow path extends from the air inlet to an air outlet disposed within at least one of the front wall and an opposing sidewall of the cabinet.

11. The laundry appliance of claim 1, wherein the processing belt is a porous structure that allows fluid and air to pass therethrough.

12. A laundry appliance comprising:

a cabinet defining a processing chamber within an interior of the cabinet; and a processing belt positioned between opposing sidewalls of the cabinet and partially defining the processing chamber, wherein the processing belt translates vertically within the interior to define a rear portion of the processing chamber, and wherein a front portion of the processing chamber is defined by a front wall of the cabinet that includes a door aperture that selectively receives an operable door in a closed position.

13. The laundry appliance of claim 12, wherein the processing belt is operable in a tumbling condition that operates the processing belt in a single direction, and wherein the processing belt is operable in an agitation condition that includes a reciprocal motion of the processing belt within the processing chamber.

14. The laundry appliance of claim 12, further comprising:

a machine compartment positioned within the interior, wherein the processing belt partially separates the machine compartment from the processing chamber; and a drive train that defines an operational path of the processing belt, wherein a tumbling portion of the operational path defines a portion of the processing chamber and a return portion of the operational path is positioned distal from the processing chamber.

15. The laundry appliance of claim 14, wherein the processing belt is operational in an unload condition that directs the tumbling portion of the operational path of the processing belt toward the door aperture, wherein the unload condition is further defined by the operable door being in an open position.

16. The laundry appliance of claim 14, wherein a bottom of the processing chamber includes a basin that holds a volume of process fluid, and wherein at least the tumbling portion of the processing belt translates through the basin.

17. The laundry appliance of claim 12, wherein the processing belt is a porous material that allows fluid and air to pass therethrough.

18. A laundry appliance comprising:

a cabinet having a front wall with a door aperture and defining an interior;

a processing chamber defined within the interior, wherein a front portion of the processing chamber is defined by the front wall of the cabinet;

a processing belt that partially defines the processing chamber and translates vertically within the interior, wherein the processing belt defines a rearward boundary of the processing chamber that opposes the door aperture;

a machine compartment positioned within the interior, wherein the processing belt partially separates the machine compartment from the processing chamber; and a drive train that defines an operational path of the processing belt, wherein a tumbling portion of the operational path defines a portion of the processing chamber and a return portion of the operational path is positioned distal from the processing chamber.

19. The laundry appliance of claim 18, wherein the processing belt is a porous material that allows fluid and air to pass therethrough.

20. The laundry appliance of claim 19, wherein a fluid path and an airflow path extend through the processing chamber, and wherein at least one of the fluid extends through the processing chamber and extends through the processing belt.

* * * * *